US005375802A

United States Patent [19]

Branham, II

[11] Patent Number: 5,375,802

[45] Date of Patent: Dec. 27, 1994

[54] STRUCTURE FOR FASTENING FACING STRUCTURAL UNITS

[75] Inventor: William K. Branham, II, Louisville, Ky.

[73] Assignee: Bill Branham Designs, Ltd., Louisville, Ky.

[21] Appl. No.: 153,641

[22] Filed: Nov. 17, 1993

[51] Int. Cl.[5] ..... A47B 96/06

[52] U.S. Cl. ..... 248/231.4; 52/36.4; 211/94; 248/220.4

[58] Field of Search ..... 248/231.4, 323, 220.4, 248/221.2, 221.4, 220.3, 221.1, 221.3, 225.1, 225.2, 231.8, 316.4; 52/36.4, 36.5; 211/94

[56] References Cited

U.S. PATENT DOCUMENTS

| | | | |
|---|---|---|---|
| 2,535,563 | 12/1950 | Boyer et al. | 248/231.4 X |
| 2,697,572 | 12/1954 | Pfankuch | 248/231.4 X |
| 3,697,034 | 10/1972 | Shell | 248/243 |
| 3,891,172 | 6/1975 | Einhorn | 248/223 |
| 4,004,856 | 1/1977 | Wesseler | 403/186 |
| 4,118,003 | 10/1978 | Dillow | 248/231.4 X |
| 4,679,368 | 7/1987 | Pettings et al. | 52/36.4 |
| 5,138,803 | 8/1992 | Grossen | 211/94 X |
| 5,142,832 | 9/1992 | Branham et al. | 52/36.4 |

FOREIGN PATENT DOCUMENTS

| | | | |
|---|---|---|---|
| 2450582 | 11/1980 | France | 211/94 |

*Primary Examiner*—Ramon O. Ramirez

*Attorney, Agent, or Firm*—Polster, Lieder, Woodruff & Lucchesi

[57] ABSTRACT

A structural assembly for fastening together and disengaging a slotted supporting unit and a supported unit having adjustable gripping means mounted thereon cooperable with the slotted supporting unit to apply compressive forces to the supporting unit and resulting tensile forces to the supported unit in order to maintain the fastened together units in facing planer relationship.

10 Claims, 1 Drawing Sheet

STRUCTURE FOR FASTENING FACING STRUCTURAL UNITS

BACKGROUND OF THE INVENTION

The present invention relates to a unique arrangement for fastening facing structural units and more particularly to an inventive mounting system for fastening and disengaging facing panels one of which panels is provided with slots and the other of which panels is provided with gripping members to cooperate with such slots to hold the panels fast in uniform relation.

It is generally known to fasten two structural units together by including slots in one of the units and gripping projections on the other to fasteningly engage in such slots, attention being directed to U.S. Pat. No. 3,697,034, issued to Irving W. Shell on Oct. 10, 1972, which teaches such an arrangement and includes a spring-loaded locking bar to lock one of the projections on one structural unit in place when engaged and assembled with a slot on the other structural unit. Attention further is directed to U.S. Pat. No. 3,891,172, issued to Ruediger Einhorn on Jun. 24, 1975, which teaches an adjustable cam locking device included with a slot-projection assembly for a support member mounted to a slotted panel wall. Attention also is directed to the slot and projection assembly of U.S. Pat. No. 4,004,856, issued to Gerhard Wesseler on Jan. 25, 1977, which teaches the use of wedges to tighten hook projections when assembled into slots and to U.S. Pat. No. 4,679,368, issued to Frederic R. Pettings et al on Jul. 14, 1981, which discloses the use of a comparatively complex structure including a spring and a locking device disposed in a panel wall to urge and lock a slidable hook member into engagement with a standard to which the panel wall is joined. In addition, attention is directed to U.S. Pat. No. 5,142,832, issued to William K. Branham et al on Sep. 1, 1992, which teaches a slotted supporting panel structure similar to the supporting panel disclosed herein, the disclosed supporting panel slots being shaped to receive a mounting stud and clamp assembly which, as described hereinafter can be utilized in consolidation with the novel structure of the present invention.

Finally, it is to be noted that the present invention, although not limited to the use thereof, can effectively utilize commercially available mounting clips in the novel structure described herein. In this regard, attention is directed to the long available set of four mirror clips sold as a package by C.R. Laurence Co., Inc. of Los Angeles, Calif. The package includes two stationary or unitary clips and two spring-loaded adjustable clips, the clips being accompanied by screws for mounting on a mirror support panel. The stationary or unitary clips can be set at a desired height on the support panel to receive and support the bottom of a mirror to be mounted on the support panel. Appropriate markings for setting the adjustable clips at the mirror top can then be made on the support panel and the adjustable clips then set on the support panel at such markings. The mirror then can be mounted by inserting the top edge thereof in the spring-loaded adjustable clips pushing the mirror up on the clips against the spring-load to thus set the mirror down in the bottom unitary clips with the mirror being compressively supported on the support panel between the top and bottom clips.

The present invention utilizes spring-loaded clips of this type and the slotted wall and mounting arrangement of U.S. Pat. No. 5,142,832, in a novel structural mounting system heretofore unknown in the art, the novel structural arrangement disclosed herein allowing for straight forward and economical manufacture and assembly with a minimum of parts involved and with a minimum of steps required to accomplish assembly operations. Not only does the unique structure of the present invention lend itself to ready domestic and commercial use for mounting lamps, shelves and display items on a wall, but in addition it has unique structural use in other display areas including architectural wall paneling and billboard displays, allowing the holding of a supported member in these numerous possible applications in fast relation to a support member without an undesirable bending or arcing of such supported member.

Various other features of the present invention will become obvious to one skilled in the art upon reading the disclosure set forth herein.

BRIEF DESCRIPTION OF THE INVENTION

More particularly the present invention provides a structural arrangement for fastening together and disengaging oppositely facing structural units, one of which units is a supporting unit and the other of which is a supported unit comprising: longitudinally extending grip receiving means on the supporting unit; adjustable gripping means on the supported unit preselectively positioned to engage with the grip receiving means on the supporting unit; and, adjusting means cooperable with the gripping means to apply compressive fastening forces to the supporting unit and tensile forces to the supported unit when the grip receiving and adjustable gripping means are engaged to be held in facing preselected relation.

It is to be understood that various changes can be made by one skilled in the art to one or more of the several parts of the structure disclosed herein without departing from the scope or spirit of the present invention. For example, other types and shapes of structural supporting and supported units can be utilized, as can other tensioning and compressing structures.

BRIEF DESCRIPTION OF THE DRAWINGS

Referring to the drawing which discloses an advantageous embodiment of the invention.

DETAILED DESCRIPTION OF THE DRAWINGS

Figure 1:
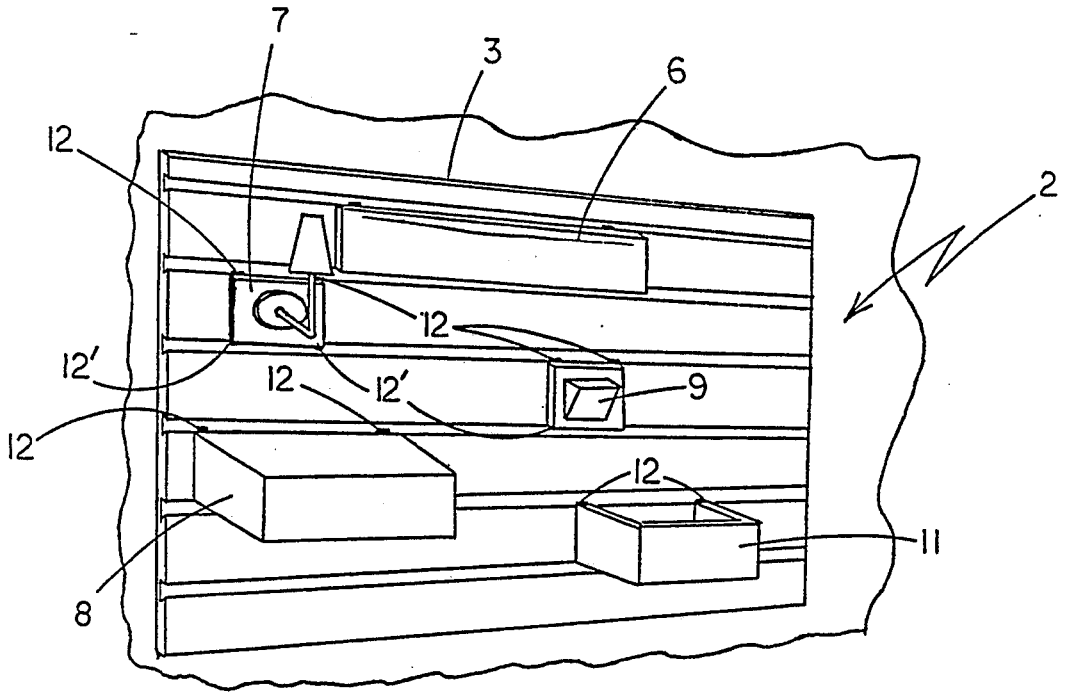
FIG. 1 is a perspective view of a slotted supporting display panel mounted on a wall with several units supportingly mounted on such panel in accordance with the present invention.

Referring to FIG. 1 of the drawings, a novel structural display arrangement 2 for fastening together and disengaging oppositely facing structural vertical panel members is shown.

Display arrangement 2 includes a wall mounted slotted vertical supporting panel 3 having a plurality of spaced, horizontally extending grip receiving means in the form of slots 4 disposed therein to extend between the spaced vertical side edges of panel 3 the slots 4 being shaped and contoured in a fashion as shown in above-mentioned U.S. Pat. No. 5,142,832. It is to be understood that other shaped slots or other grip receiving means such as protrusions could be utilized in association with a supporting panel 3 without departing from the scope or spirit of the present invention.

As shown in FIG. 1 of the drawing, a number of different items including a soon to be marketed TV display panel 6, a lamp 7, a box 8, a wedge-shaped shelf 9 and a U-shaped support base 11 are shown as mounted in supported fashion between pairs of slots 4 of panel 3. Depending upon the unit to be mounted, the slots can be adjacent ones or removed from each other by intervening slots.

Figure 2:
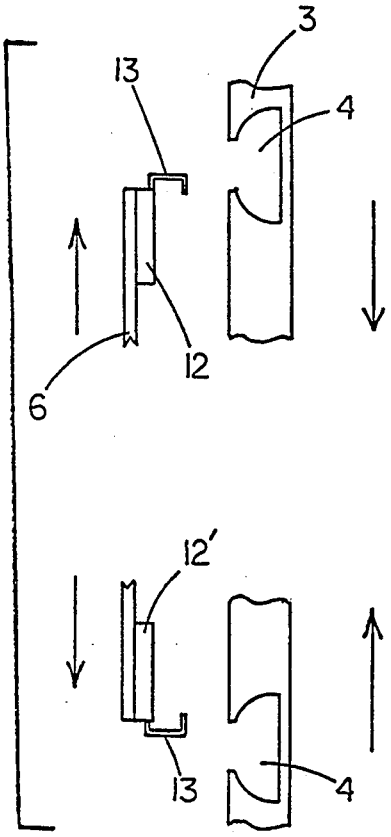
FIG. 2 is a partially broken away enlarged cross-sectional view of a portion of an apparatus such as shown in FIG. 1, the arrows indicating the compression and tension forces on the supporting and supported units, respectively; and, FIG. 3 is an enlarged, schematic view of a spring-loaded adjustable clip member of the present invention.

Each of the above items to be supported from slots 4 of panel 3 advantageously includes two pairs of spaced clip members 12 and 12' which can be fastened to the upper and lower corners respectively of the item or panel to be supported, or at some other select area of the supported item. As can be more readily seen in FIGS. 2 an 3 of the drawing, each clip member 12 and 12' includes a slot gripping portion 13 of U-shaped configuration which is sized and shaped to nestingly engage with one of the spaced horizontally extending slots 4 of vertical supporting panel 3. It is to be noted that one of the pair of clip members, designated by reference numeral 12 which can be fastened to the upper corners of the supported item or panel such as items 6, 7, 8, 9 and 11, is of a stationary unitary nature to allow efficient weight holding suspension of the supported item or panel from an upper horizontal slot 4 of supporting panel 3. Each of the other pair of clip members, designated by reference numeral 12', can be fastened to the lower corners of the supported item or panel. Each of the clip members 12', are adjustably spring-loaded to include two relatively moveable sections, one of which sections is guidable relative the other and includes a slot gripping portion 13, as aforedescribed, of U-shaped configuration which is sized and shaped to nestingly engage with a lower of the spaced horizontally extending slots 4 of support panel 3 to apply compressive forces to the supporting panel portion 3 gripped between the spaced horizontal slots 4 and resultant tension forces to the supported panel or supported unit, such as 6, on which clip member pairs 12 and 12' are fastened. In this regard, attention is directed to the arrows disclosed in FIG. 2 of the drawing which schematically illustrates the direction of the forces as applied to supporting panel 3, namely compression and to supported panel 6 on which clips 12 and 12' are mounted, namely resultant tension.

Figure 3:
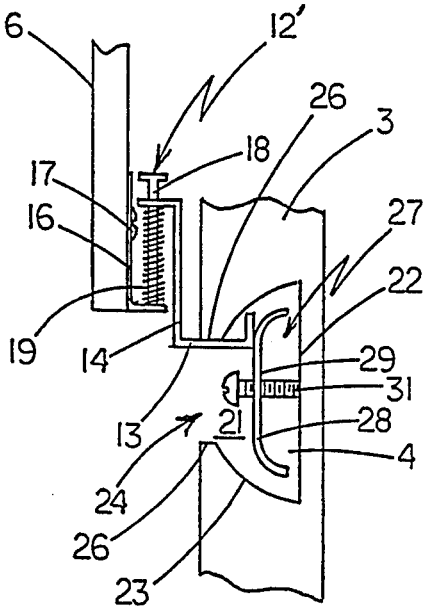

Referring to FIG. 3 of the drawing, two relatively moveable sections 14 and 16 of an adjustable clip member 12' are disclosed. In this Figure, section 16 is disclosed as being L-shaped in cross-section with the longer leg fastened by screw 17 to the lower face of a panel 6. The shorter leg of section 16 has a T-shaped guide bar 18 mounted thereon about which is positioned a compressible spring 19. Above spring 19 a short leg of relative moveable section 14 of Z-shaped cross-section is slidably mounted on guide bar 18. When clip member section 14 is moved downwardly relative section 16 against spring 19 to insert slot gripping portion 13 thereof into slot 4 of supporting panel 3 and then released lower clip member 12' and its opposed upper clip member 12 apply a compressive force to the gripped portion of supporting panel 3 and a resultant tension force to that portion between mounted clips 12 and 12' on supported panel 6. (see FIG. 2). It is to be understood that various type clip arrangements and positionings can be utilized to accomplish the desired results and, as aforementioned, clip sets such as the mirror clips commercially available from the C. R. Laurence Co., Inc. of Los Angeles, Calif. can be utilized in the present invention.

As also can be seen in FIG. 3 of the drawing, the present invention readily lends itself to be combined with a locking bar device such as that disclosed in aforementioned in U.S. Pat. No. 5,142,832. In this regard, it is to be noted that slot 4 can include an interior pocket portion 21 bounded by a rear wall 22, a front wall 23 and an entrance 23 bisecting the front wall 23 with the front wall 23 extending from the edges of rear wall 22 forwardly in an arcuate configuration and having terminal lip-like portions 26 forming the edge of entrance 24. A locking assembly 27, which can either be mounted on a clip member 12 or 12' or which can be separate therefrom is provided in order to lock slot gripping portion 13 into slot 4. Assembly 27 includes an arcuate base locking bar 28 complementary to the arcuate configuration of the front wall 23 of the pocket portion 21 of slot 4. Bar 28 has a width less than the width of entrance 24 of slot 4. A threaded hole 29 is provided in the center of locking bar 28 and a threaded stud 31 passes therethrough to be accessible at one slotted end at entrance 24. The locking bar 28 can be inserted advantageously into pocket 4 prior to or even after insertion of gripping portion 13 and when properly positioned in slot 4, turning of threaded stud 31 in the threaded hole 29 of locking bar 28 and into abutment with rear wall 22 selectively moves bar 28 into and out of locking engagement with the gripping portion 13 of clip member 12 or 12' inserted into said slot 14.

The invention claimed is:

1. A structural arrangement for fastening together and disengaging oppositely facing structural units one of which is a supporting unit and the other of which is a supported unit comprising:

longitudinally extending grip receiving means on said supporting unit;

a pair of relatively adjustable gripping means independently and separately mounted in spaced relation on said supported unit to be preselectively positioned to engage with said grip receiving means on said supporting unit; and, adjusting means for at least one of said pair of adjustable gripping means to apply compressive fastening forces to said supporting unit and tensile forces to said facing supported unit when said grip receiving means and said adjustable gripping means are engaged with said structural units in facing relation.

2. The structural fastening arrangement of claim 1, said grip receiving means comprising at least one longitudinally extending slot positioned in said supporting unit to extend between opposed side edges of said supporting unit.

3. The structural fastening arrangement of claim 1, said grip receiving means comprising at least one pair of spaced longitudinally extending horizontal slots extending between opposed vertical side edges of said supporting unit.

4. The structural fastening arrangement of claim 1, said grip receiving means comprising at least one longitudinally extending slot in said supporting unit and said adjustable gripping means comprising at least one pair of spaced adjustable clip members with at least one of said pair of clip members having a U-shaped cross-sectional configuration to engage in said longitudinally extending slot in said supporting unit.

5. The structural fastening arrangement of claim 4, one of said pair of clip members being adjustable and the other being stationary to allow suspension of said supported unit on which it is mounted while the other of said clip members of said pair is adjusted for gripping engagement with said grip receiving means.

6. The structural fastening arrangement of claim 1, said adjustable gripping adjusting means including spring loading means cooperative therewith for applying said compressive and tensile forces to said supporting and supported units, respectively.

7. The structural fastening arrangement of claim 1, said grip receiving means comprising at least one longitudinally extending slot in said supporting unit and said adjustable gripping means comprising at least one pair of spaced adjustable clip members both having a U-shape cross-sectional configuration to allow slot engagement, one of said spaced pair of clip members being of one unitary piece to allow engagement and support of said supported unit relative said supporting unit and the other of said pair of clip member including at least two relatively moveable sections one of which sections is fastenable to said supported unit and includes a guide post for the other section which is spring-load mounted on said guide post for relative spring-loaded movement therebetween.

8. The structural fastening arrangement of claim 1, and locking means cooperable with said adjustable gripping means to lock the same in place when engaged in said grip receiving means.

9. The structural arrangement of claim 1, said grip receiving means comprising at least one longitudinally extending slot positioned in said supporting unit to extend between opposed side edges of said supporting unit, said slot including an interior pocket portion bounded by a rear wall, a front wall and an entrance bisecting said front wall, said front wall extending from the edges of said rear wall forwardly in an arcuate configuration and having terminal lip-like portions forming the edge of said entrance; a locking assembly mounted on said adjustable gripping means including an arcuate base locking bar complementary to the arcuate configuration of said front wall of said pocket portion of said slot and having a width less than the width of said entrance of said slot, and a threaded hole in the center portion of said locking bar; and, a threaded stud projecting from said adjustable gripping mean and cooperable therewith, said threaded stud having one end fitted and threaded in said threaded hole of said locking bar for insertion of said locking bar into said pocket portion of said slot to be positioned between said adjustable gripping means and the rear wall of said pocket portion of said slot when said locking bar is in alignment with the width of said entrance of said slot for selective movement of said stud in said pocket portion against the rear wall of said pocket portion so that turning said threaded stud in said threaded hole of said locking bar and in abutment with said rear wall selectively moves said locking bar threaded thereon in and out of locking engagement with said adjustable gripping means.

10. A structural arrangement for fastening together and disengaging oppositely facing structural vertical panel units, one of which units serves as a vertical supporting panel and the other a vertical supported panel unit to be supported thereby in facing relation comprising:

at least one pair of spaced horizontal slots extending between the spaced vertical side edges of said vertical supporting panel;

two pairs of spaced clip members fastened to the upper and lower corners of said supported panel, each of which clip members includes a slot gripping portion of U-shaped configuration to nestingly engage with one of said horizontal slots of said vertical supporting panel, each of one of said pairs of clip members fastened to the upper corners of said supported panel being a stationary unitary piece to allow suspension of said supported panel from the upper horizontal slot of said supporting panel and each of the other of said pairs of clip members fastened to the lower corners of said supporting panel including at least two relatively moveable sections one of which sections includes said U-shaped configuration to be engageably fastenable to the lower horizontal slot of said supporting panel and is spring-loaded and guidably moveable relative the other section which is fastened to said supporting panel so as to apply compressive forces to the supporting panel portion between said spaced horizontal slots and resultant tension forces to the supported panel on which said clip members are fastened and bar locking means insertable in said slots and cooperable with said clip members when fastened in said slots to lock the same in place.

* * * * *

UNITED STATES PATENT AND TRADEMARK OFFICE

CERTIFICATE OF CORRECTION

PATENT NO. : 5,375,802

DATED : December 27, 1994

INVENTOR(S) : William K. Branham II

It is certified that error appears in the above-indentified patent and that said Letters Patent is hereby corrected as shown below:

Column 3, line 37, before "adjustably" change "are" to --- is ---;

Column 4, line 15, after "entrance," change "23" to --- 24 ---;

Claim 6, Column 5, line 12, before "adjustable" delete "adjustable gripping".

Signed and Sealed this

Twenty-first Day of March, 1995

*Attest:*

Bruce Lehman

BRUCE LEHMAN

*Attesting Officer*

*Commissioner of Patents and Trademarks*